US007385514B2

(12) United States Patent
Dempsey

(10) Patent No.: US 7,385,514 B2
(45) Date of Patent: Jun. 10, 2008

(54) BIO-FEEDBACK WALKER DEVICE

(76) Inventor: Levi Dempsey, 6701 Seat Pleasant Dr., Capitol Heights, MD (US) 20743

( * ) Notice: Subject to any disclaimer, the term of this patent is extended or adjusted under 35 U.S.C. 154(b) by 279 days.

(21) Appl. No.: 11/398,813

(22) Filed: Apr. 5, 2006

(65) Prior Publication Data

US 2008/0042853 A1 Feb. 21, 2008

Related U.S. Application Data

(60) Provisional application No. 60/669,140, filed on Apr. 6, 2005.

(51) Int. Cl.
*G08B 23/00* (2006.01)

(52) U.S. Cl. ..... 340/573.1; 340/514; 340/665; 340/825.19

(58) Field of Classification Search ..... 340/573.1, 340/514, 665, 825.19, 573.7
See application file for complete search history.

(56) References Cited

U.S. PATENT DOCUMENTS 4,858,125 A 8/1989 Washizuka et al.
5,014,705 A * 5/1991 Graupe et al. ..... 607/49
5,081,989 A * 1/1992 Graupe et al. ..... 607/63
5,092,329 A * 3/1992 Graupe et al. ..... 607/66
5,305,773 A * 4/1994 Browning ..... 135/67
5,511,571 A 4/1996 Adrezin et al.
5,603,677 A 2/1997 Sollo
5,794,639 A 8/1998 Einbinder
5,853,219 A * 12/1998 Santuccio ..... 297/5
6,011,481 A 1/2000 Luther et al.
6,356,210 B1 3/2002 Ellis
2005/0077345 A1 4/2005 March
2005/0229961 A1 10/2005 Takizawa et al.

* cited by examiner

*Primary Examiner*—Daryl C Pope
(74) *Attorney, Agent, or Firm*—Edwin P. Tarver; Patel & Alumit, PC

(57) ABSTRACT

A device for providing grip strength feedback and alerting users when gripping strength fails used. The device comprises a trigger wire, two switches, an alerting means associated with the switches and a battery. A first end of the trigger wire is connected to one of the switches and a second end of the trigger wire is connected to the other switch. The device is secured on a handle of the walker such that the trigger wire is located below the handle of the walker and is grasped by the user and the ulna side and radial sides of the hand of the user are associated with the first and second ends of the trigger wire, respectively. The alerting means sends an audible alarm when the grasping strength of the user is weakened or completely lost.

10 Claims, 8 Drawing Sheets

BIO-FEEDBACK WALKER DEVICE

CROSS-REFERENCE TO RELATED APPLICATION

This is a utility patent application which claims benefit of U.S. Provisional Application No. 60/669,140 filed on Apr. 6, 2005.

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

The present invention generally relates to walking aid devices with sensors, and more particularly to a device that provides biofeedback about the grasp of a user, when used in conjunction with a walker. The device is used for treatment of patients with poor or impaired motor skills and senses.

Walking aids are generally used by elderly people and by people who are affected by diseases such as hemiplegia and who have sustained leg injuries. Although the use of the walking aids may be temporary in some cases, people affected by acute hemiplegia or other similar diseases may need to use them for longer periods. People affected by such diseases have limited use of their arms and hands due to loss of their range of motion, muscle weakness, or sensory loss. During rehabilitation, patients usually try to walk with the help of walking aids, such as a walker device, a walking stick, or a crutch. These walking aids may include sensing devices to get a feedback of the patient's condition based on grasping strength, load distribution, etc.

Several walking aids with sensors have been developed in art. For example, U.S. Pub. No. 20050077345 to March discloses a walker distance measuring device for quantifying the movement and the travel of a patient using the walker. The device is to be installed upon the walker. The device comprises a wheel assembly, a measuring assembly and a display. The wheel assembly is capable of attachment to a walker, and includes a support and a wheel. The measuring assembly comprises a sensor having a trigger associated with one of the support and the wheel and a pickup associated with the other of the support and the wheel. A processor is electronically coupled with the sensor. The processor is capable of interpreting the information received from the sensor. The display is associated with the processor for displaying results. The nature of the biofeedback information, i.e. the distance measurement of the walker provided by this device is different from the present invention.

U.S. Pat. No. 6,011,481 to Luther discloses a walking cane with sensors for supporting a patient and as well as for providing a biofeedback. The walking cane includes a handle, a vertical shaft, and multiple legs. Each of the legs is associated with electronic stress/load sensors that are coupled with an electronic processing module. The electronic processing module evaluates the input from the cane legs and activates a warning to the user in the event that the load sensors on the legs detect a load distribution indicative of an approaching unstable situation. The user can then stop and probe with the cane until a stable position is found. The feedback provided by this apparatus is based on measuring the load distribution among the legs of the walking cane unlike the present invention, which is based on the measurement of the grasping strength of a patient.

U.S. Pat. No. 5,511,571 to Adrezin discloses a method and apparatus for gait measurement of a patient. A walking aid such as a walker, cane, or crutch is instrumented with load sensors to measure the loads in the aid as it is being used. The measured loads are used to analyze the user's gait to insure proper selection and sizing of a walking aid, stability of the user, and proper limb loading. In a preferred embodiment, strain gauges are mounted on the legs of a walker and connected through a signal processing interface to a computer for data analysis and display. The gauges are mounted, calibrated, and connected to the signal processing interface so as to permit measurement of the axial, bending, and torsional forces in each leg of the walker as it is being used. This data is then used for qualitative and quantitative assessment of the user's gait. The feedback provided by this apparatus is based on the measurement of the load distribution in the legs of the walker, which is different from that of the present invention, which measures grasping strength and alerts the patient in case of insufficient grasp.

Although many walking aids associated with feedback sensors have been developed, the object of the present invention is to provide a bio-feedback device for assisting the treatment of patients with impaired ambulatory sense, when used in conjunction with a walker.

A further object of the present invention is to provide a bio-feedback device, which assesses grasping strength of a patient.

Finally, it is an object of the present invention to provide a biofeedback device, which alerts a patient using the walker when his/her grasping strength is below an expected level. These and other objects of the present invention will become better understood with reference to the appended Summary, Description, and Claims.

SUMMARY

The present invention generally relates to walking aid devices with sensors, and more particularly to a grasp alerting device for use in conjunction with a walker. The grasp-alerting device is used to provide biofeedback by alerting a patient based on the grasping strength. The device includes a handle portion and a control box connected to the handle portion. The handle portion comprises two flange-like members, a connecting member connecting the flange-like members, a switch housed in the each flange-like member, and a trigger wire extending between the flange-like members. The two ends of the trigger wire are connected to the switches. The control box of the device comprises a battery, a toggle switch for activating the device, an on/off button, two light indicators, and two audible alarms. One of the light indicators and the audible alarms are connected to a first switch, while the other light indicator and the audible alarm are connected a second switch.

An installation means is used to install the device over the handle of a walker. After installation, the trigger wire is below the walker handle. A patient is then asked to grasp the walker handle along with the trigger wire. If the patient holds the walker with sufficient strength to depress both ends of the trigger wire, the indicator lights remain on, and the device makes no sound. If a user's grip loosens, the light indicators turn off and audible alarms are activated.

FIGURES—REFERENCE NUMERALS

Figure 1:
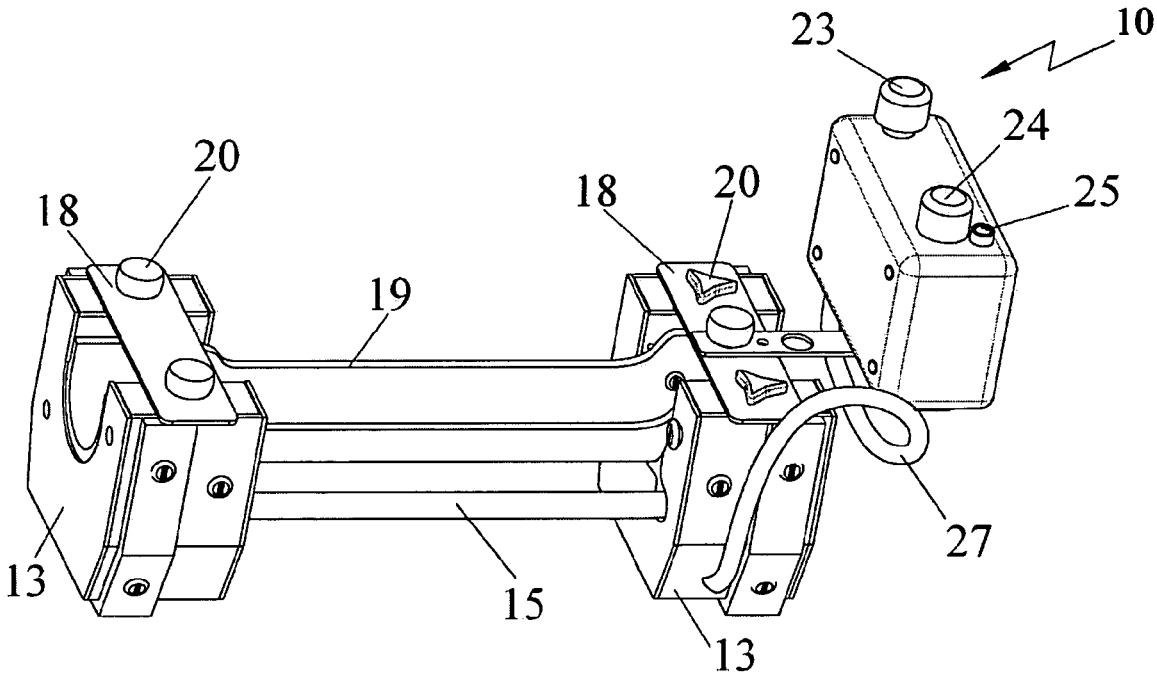
FIGS. 1 through 4 are perspective views of the grasp-alerting device in accordance with the present invention.
Figure 2:
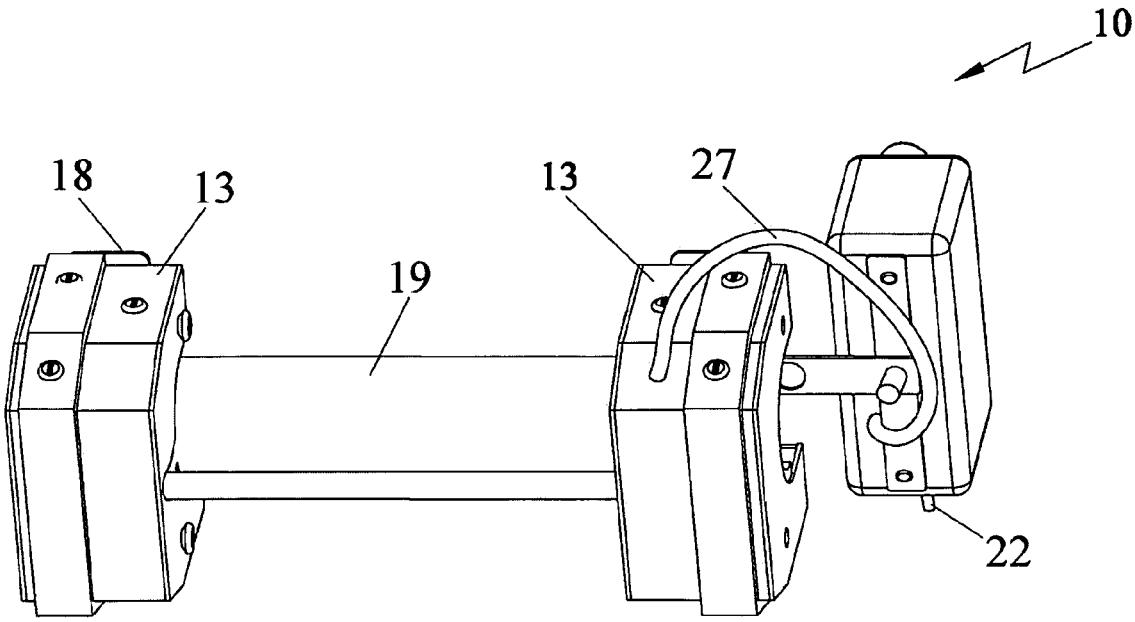
Figure 3:
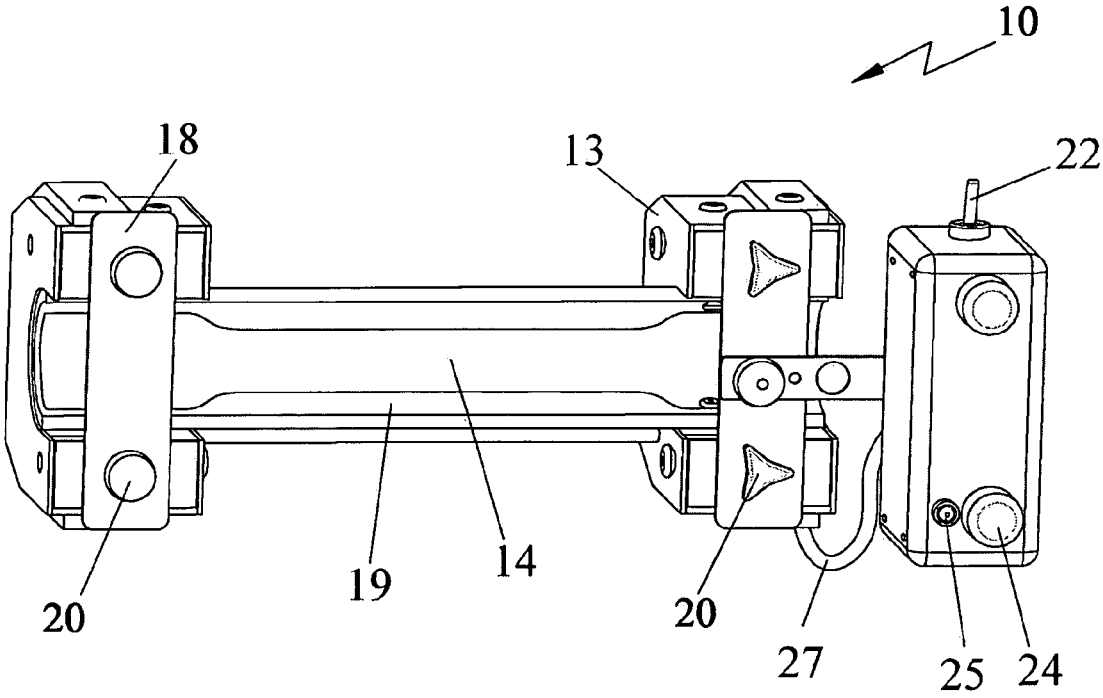
Figure 4:
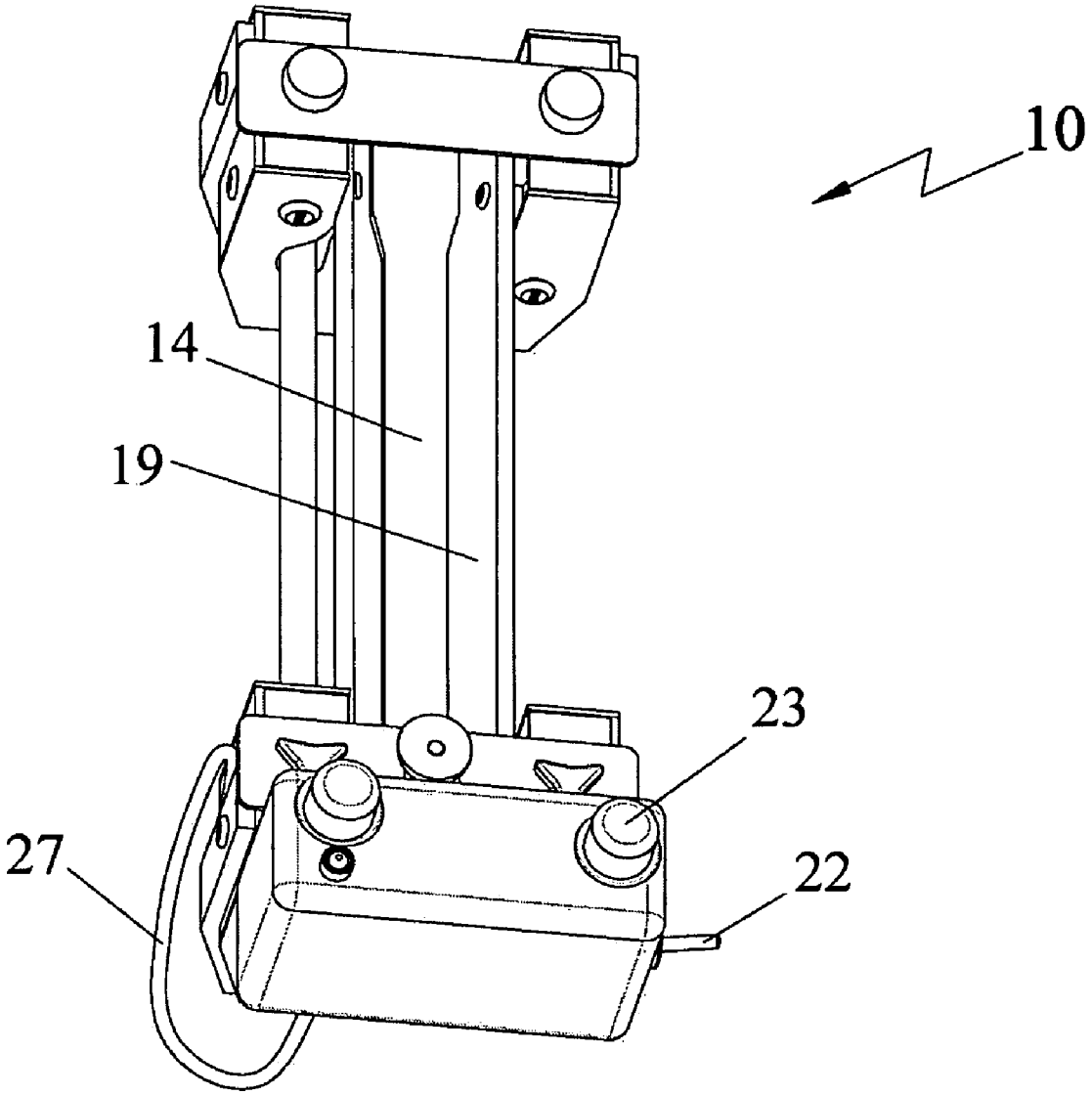

10 . . . Grasp-alerting Device
11 . . . Handle of the Walker
12 . . . Walker
13 . . . Flange-like Member
14 . . . Connecting Member Cushion
15 . . . Trigger Wire
16A . . . Forward Switch
16B . . . Rear Switch
17 . . . Semi-circular Groove
18 . . . First Plate-like Member
19 . . . Connecting Member
20 . . . Thumb Screws
21 . . . Battery
22 . . . Toggle Switch
23 . . . Push Button
24 . . . Forward Switch Indicator Light
25 . . . Rear Switch Indicator Light
26 . . . Audible Alarm
27 . . . Connecting Wire
28 . . . Second Plate-like Member
29 . . . Alternate Embodiment of the Device
30 . . . Flange-like Member of the Alternate Embodiment
31 . . . Strap with Hook and Loop Fasteners

DETAILED DESCRIPTION

Referring to the drawings, a preferred embodiment of a grasp-alerting device 10 is illustrated in FIGS. 1 through 8. The present invention is a battery-operated grasp alerting device 10 that is used in conjunction with a walking aid such as a walker. The device 10 assesses the grasping strength of a patient using the walker and notifies a user of physical therapist in the event a patient looses their grip.

Referring to FIGS. 1 through 4, the device 10 can be divided into a handle portion and a display/alerting portion connected to the handle portion. The handle portion includes two flange-like members 13, a connecting member 19 connecting the two flange-like members 13, a trigger wire 15, with switches connected to each end of the trigger wire 15, and disposed inside each flange-like member. The flange-like members 13 include a semi-circular groove and a plurality of threaded holes (not shown) on their top surfaces. The semi-circular groove is suitably dimensioned to receive a walking device handle 11.

The handle portion also includes a two plate-like members 18 with a plurality of holes (not shown) and a connecting member cushion 14 to grip the handle of a walking device. The connecting member cushion 14 of the handle portion is partially enclosed by the connecting member 19, which is adapted to conform to the shape of the walker handle 11. The trigger wire 15 is positioned below the connecting member 19. The plate-like members 18 are attached to the top surface of the flange-like members 13 by using thumb screws 20. In a preferred embodiment of the invention, thumb screws 20 are used to allow easy removal and reinstallation of the device 10.

Figure 7:
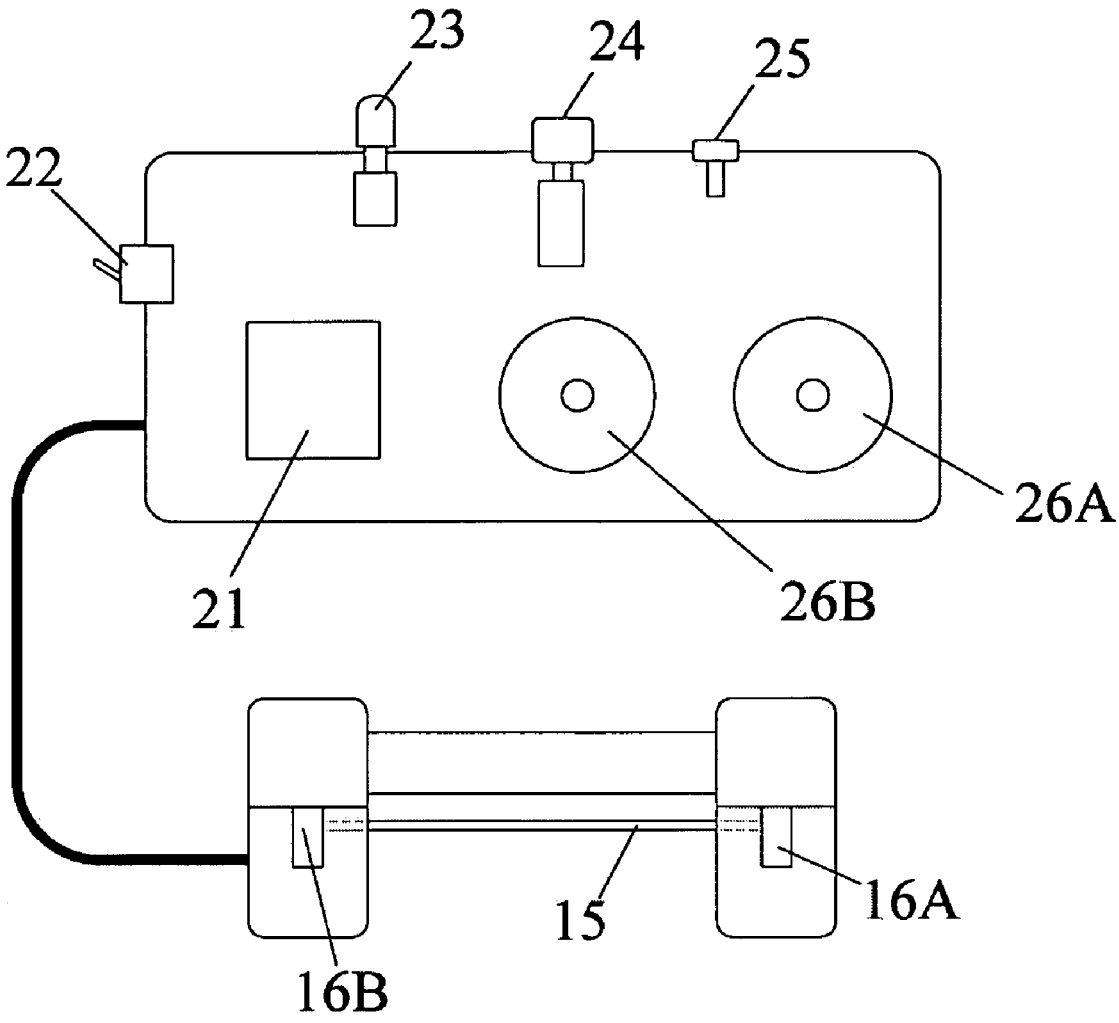
FIG. 7 is an outline of all the hardware components and their connections of the grasp-alerting device in accordance with the present invention.
Figure 8:
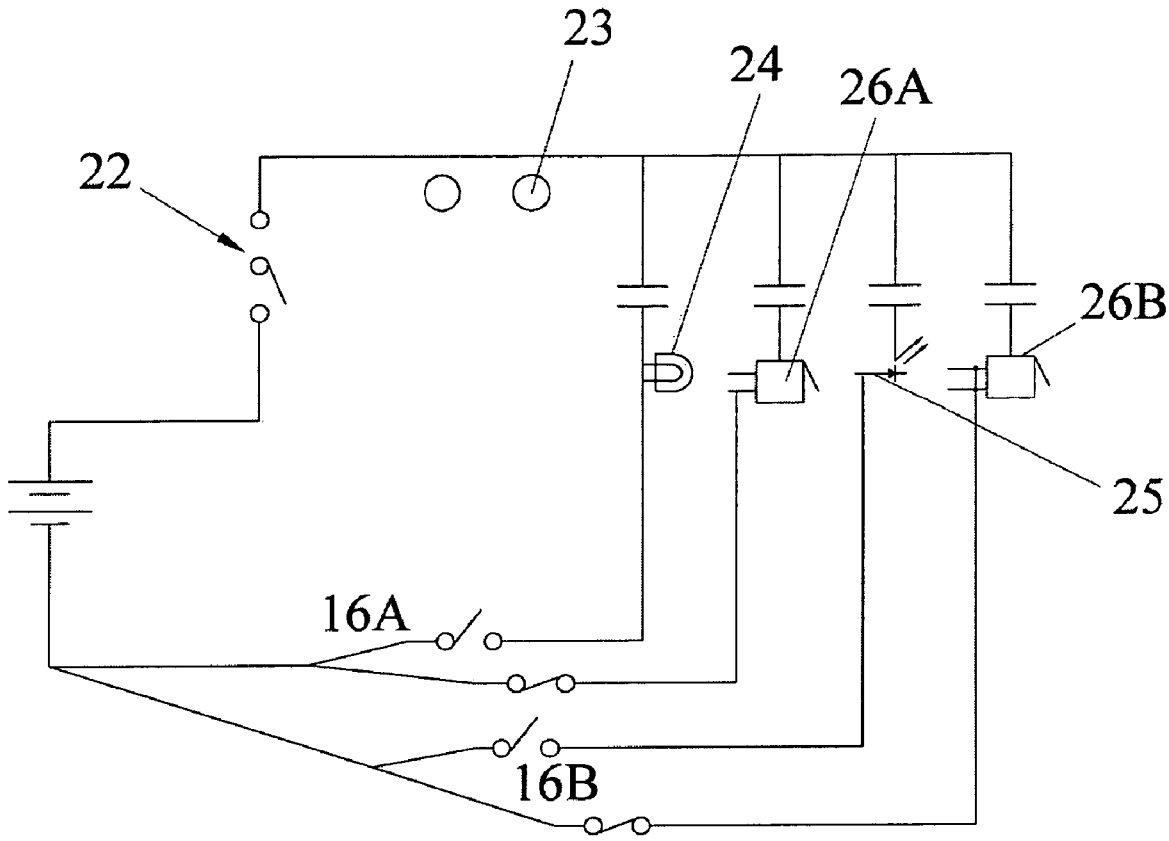
FIG. 8 is a circuit diagram of the present invention.

Still referring to FIGS. 1 through 4, The display/alerting portion comprises the control box of the device and includes an internal battery, a toggle switch 22 for activating the device 10, a push button 23 to serve as an easily accessible on/off switch, a forward switch indicator light 24, a rear switch indicator light 25 and two audible alarms 26. Referring to FIGS. 7 and 8, the forward switch 16A is connected to a first end of the trigger wire, which is associated with the forward light indicator 24 and a first audible alarm 26A. The rear switch 16B is connected to a first end of the trigger wire, which is associated with the rear light indicator 25 and a second audible alarm 26B. A wire 27 connects the display/alerting portion to the switches in the handle portion. A second plate-like member 28 is used to connect the display/alerting portion and the handle portion. The second plate-like member 28 also includes holes and several suitable means, such as thumb screws to attach the handle portion to the display/alerting portion of the device 10.

Figure 5:
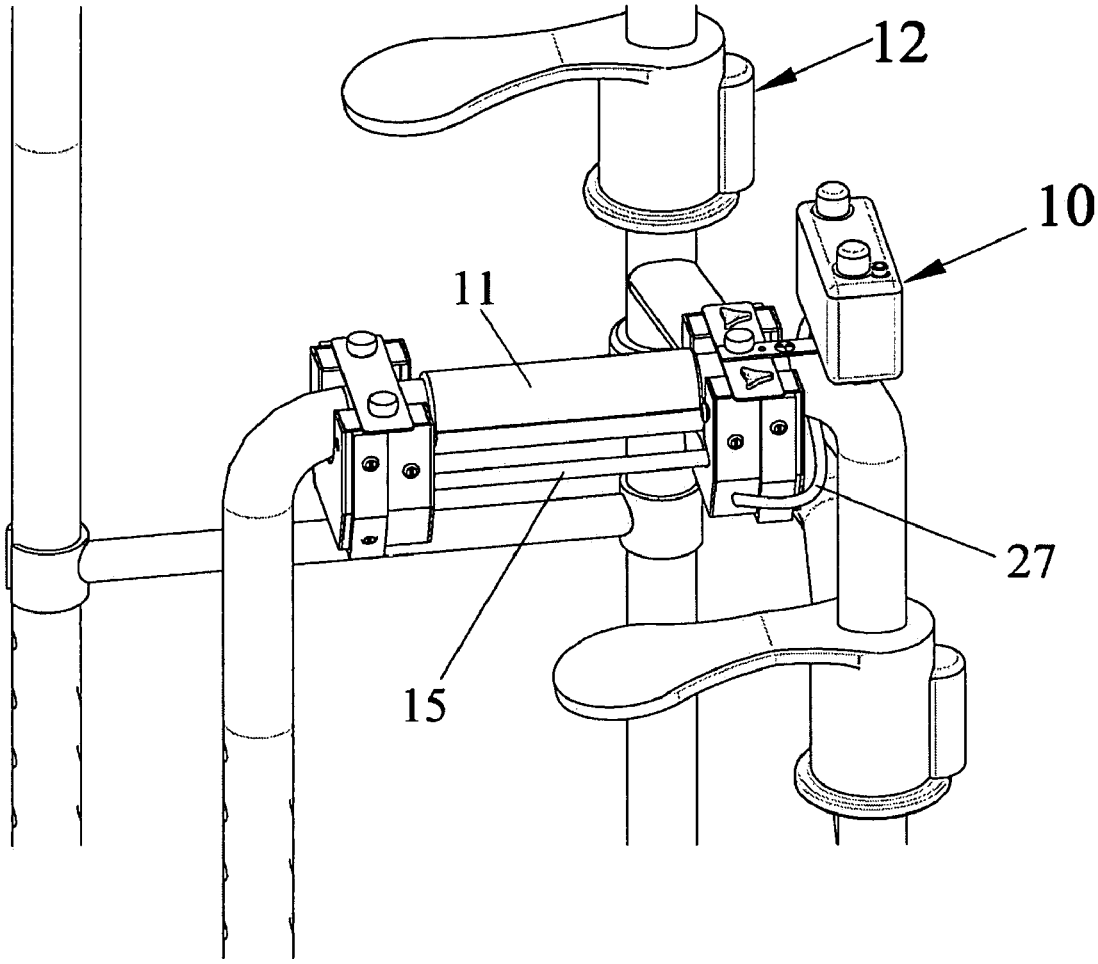
FIG. 5 is a perspective view of the grasp-alerting device installed on a walker in accordance with the present invention.

Referring to FIG. 5, in order to install the device 10, the semi-circular grooves 17 are made to receive the walker handle 11. The first plate-like member 18 is then placed over the flange-like member 13 and the handle 11. The threaded holes on the flange-like member 13 and the first plate-like member 18 are aligned and the bolts are used to attach the flange-like member and the plate-like member, thereby securing the device 10 over the handle 11 of the walker.

Figure 6:
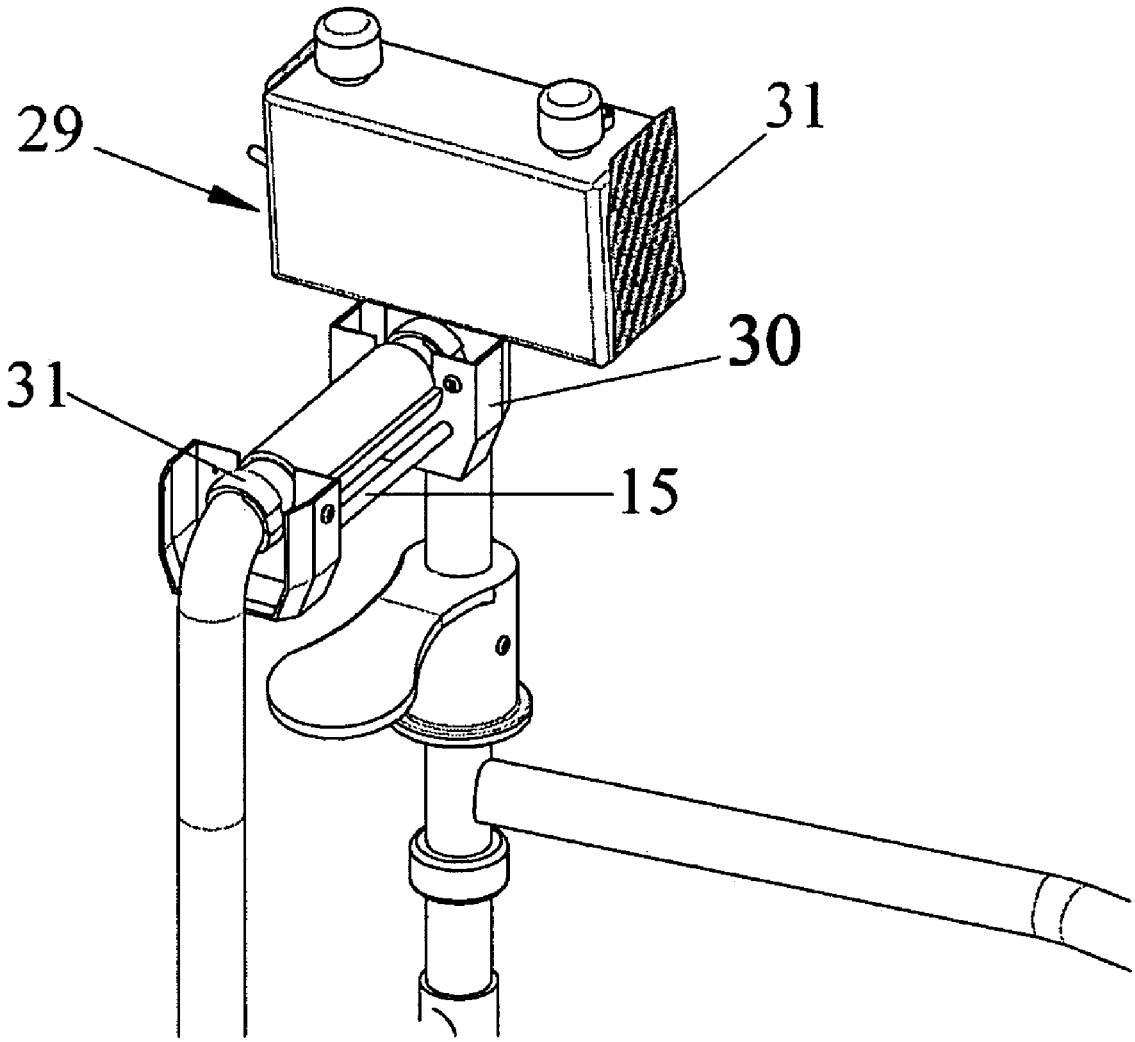
FIG. 6 is a perspective view of an alternate embodiment of the grasp-alerting device installed on a walker in accordance with the present invention.

In an alternate embodiment of the device 29 shown in FIG. 6, the flange-like member 30 is of different construction and the plate-like members are not included. A plurality of straps 31 with hook and loop fasteners are used to secure the device 29 over the walker's handle, instead of the plate-like members 18 and bolts 20 used in the preferred embodiment of the device 10. However, several suitable designs and structures are possible by using essential hardware components and establishing connections between the hardware components, as shown in FIGS. 7 and 8.

The trigger wire 15 is below the walker handle 11 after the device 10 is installed. To operate the device, the device is powered on with the toggle switch, and a patient is made to grasp the walker's handle 11 along with the trigger wire 15. Then the push button 23 can activate the switches. In a typical gripping position, the ulna side and radial sides of the patient's hand are associated with the first and second ends of the trigger wire 15, respectively. As cited earlier, the first and second ends of the trigger wire 15 are in turn associated with the two separate switches 16A and 16B. Therefore, the light signal and the first audible alarm are associated with the ulna side of the hand and the LED and the second audible alarm are associated with the radial side of the hand.

When the patient grasps the trigger wire 15, along with the walker's handle 11, with appropriate grasping strength, the light indicator 24 and the LED indicator 25 are activated, providing a visual display. The first audible alarm 26A is activated and the light indicator 24 is deactivated when the grasp on ulna side of the hand is less or lost. Similarly, the second audible alarm 26B is activated and the LED 25 is deactivated when the grasp on radial side of the hand is less or lost. The first and second audible alarms 26A and 26B employ different tones to distinguish the alarms from the ulna and radial sides. Both the first and second alarms 26A and 26B are activated when the patient completely looses the grip.

The patients are alerted once the alarms are activated and can turn off the alarms by increasing their grip. By observing the number of times the alarms go on and off, and the quality of maintained and achieved grasp of the ulna and radial sides of the hand, while performing bilateral activities or ambulating with a walker, a patient's condition can be analyzed.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. § 112, paragraph 6. In particular, the use of "step of" in the claims herein is not intended to invoke the provisions of 35 U.S.C. § 112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A device for providing feedback regarding grasping strength and continuity, used in conjunction with a walking aid, the device comprising;

two flange-like members;

a connecting member connecting the two flange-like members by maintaining a spaced relation between the two flanges;

a trigger member having a first end and a second end;

two switches, wherein each of the two flange-like members houses one of the switches, and each end of the trigger member is connected to each of the switches;

an alerting means associated with the switches;

a power supply means for supplying power to the alerting means and the switches; and a means to secure the device on the handle of a walking aid in a suitable position so that the trigger wire is located below the handle of the walker and grasped by a person using the device, wherein the ulna side and radial sides of the hand of the person are associated with the first and second ends of the trigger wire, respectively.

2. The device of claim 1, wherein the flange-like members comprise a substantially semi-circular groove for receiving the handle of the walker, a plurality of threaded holes, and a plate-like member with threaded holes.

3. The device of claim 2, wherein the handle of the walker is received in the semi-circular grooves, the plate-like member is placed over the flange-like member and the handle, and a plurality of bolts are used to attach the flange-like member and the plate-like member after aligning the threaded holes on the flange-like member and the plate-like member, thereby securing the device over the handle of the walker.

4. The device of claim 1, wherein the flange-like members comprise a substantially semi-circular groove for receiving the handle of the walker, wherein the handle of the walker is received in the semi-circular grooves and a plurality of straps with hook and loop fasteners or the like are used to secure the device over the handle of the walker.

5. The device of claim 1, wherein the alerting means associated with the first end of the trigger wire comprises a first audible alarm, and the alerting means associated with the second end of the trigger wire comprises a second audible alarm.

6. The device of claim 1, wherein when the grasping strength is below a required level, at least one of the audible alarms is activated, thereby alerting the person using the walker.

7. The device of claim 1, wherein the device further comprises two light indicators, each associated with the first and second ends of the trigger wire, the two light indicators provide a visual display of illuminated light when the required grasping strength is maintained by the person using the walker.

8. The device of claim 1, wherein a toggle switch is used to activate the device.

9. The device of claim 1, wherein the power supply means is a battery.

10. The device of claim 5, wherein the alarms are of different pitches, tones, or sounds and are distinguishable when sounded together.

* * * * *